US006474009B2

(12) United States Patent
Hahn

(10) Patent No.: US 6,474,009 B2
(45) Date of Patent: Nov. 5, 2002

(54) APPARATUS FOR FRAMING AND HANGING A SHEET-LIKE DISPLAY ITEM

(76) Inventor: Richard L. Hahn, 1380 Lake Martin Dr., Kent, OH (US) 44240

( * ) Notice: Subject to any disclaimer, the term of this patent is extended or adjusted under 35 U.S.C. 154(b) by 15 days.

(21) Appl. No.: 09/812,636

(22) Filed: Mar. 20, 2001

(65) Prior Publication Data

US 2002/0133990 A1 Sep. 26, 2002

(51) Int. Cl.[7] ..... G09F 3/20; G09F 7/22; G09F 17/00; A41F 1/00; A44B 11/25

(52) U.S. Cl. ..... 40/658; 40/617; 40/603; 40/649; 24/460

(58) Field of Search ..... 40/658, 666, 611, 40/617, 764, 791, 603, 761, 642.02, 649, 651, 653, 660, 661.03; 403/350, 351, 352; 24/67.1, 460, 461, 462, 570

(56) References Cited

U.S. PATENT DOCUMENTS 1,738,273 A * 12/1929 Anderson ..... 40/209
2,193,928 A * 3/1940 Johnson ..... 40/603
2,377,222 A 5/1945 Fruth
2,866,249 A * 12/1958 Normandin ..... 24/460
2,972,201 A 2/1961 Niedermayer
3,298,374 A * 1/1967 Grundell ..... 211/46
3,350,045 A 10/1967 Mayers
3,914,892 A 10/1975 Mohr
4,098,014 A * 7/1978 Lauer et al. ..... 40/1.5
4,105,127 A 8/1978 Holl
4,176,480 A 12/1979 Euzarraga
4,277,903 A 7/1981 Crossot
4,356,647 A 11/1982 Farris
4,459,773 A 7/1984 Sandlin
4,903,629 A * 2/1990 Maudlin et al. ..... 114/361
5,390,889 A 2/1995 Hiscock
5,638,624 A * 6/1997 Cornu ..... 24/456
5,794,372 A * 8/1998 Grana ..... 40/605
6,009,652 A * 1/2000 Smith ..... 40/606
6,298,591 B1 * 10/2001 Healy ..... 248/467
6,305,109 B1 * 10/2001 Lee ..... 40/546

* cited by examiner

*Primary Examiner*—S. Joseph Morano
*Assistant Examiner*—Jason R. Bellinger

(57) ABSTRACT

An apparatus for framing and hanging a sheet-like display item on a wall includes first and second generally identical elongate members, each member having a longitudinal channel for receiving an edge of the sheet-like display item therein with an internal means for captively retaining an edge of the sheet-like display item.

19 Claims, 7 Drawing Sheets

APPARATUS FOR FRAMING AND HANGING A SHEET-LIKE DISPLAY ITEM

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND OF THE INVENTION

This invention relates to framing and hanging upon walls sheet-like display items such as posters, calenders, and charts.

Sheet-like display items, e.g., posters, are often mounted upon walls using tacks or tape. Such mounting means are usually unattractive and detract from the display items. Further, these mounting means frequently damage the display item. Alternatively, the display items may be mounted using conventional, four-sided frames that are usually expensive.

SUMMARY OF THE INVENTION

It is an object of this invention to provide a new and improved apparatus for framing and hanging sheet-like display items that is attractive, relatively inexpensive, simple to manufacture, easy to assemble, and does not ordinarily damage the display item while securely supporting the display item. It is also an object of this invention to provide a new and improved apparatus for framing and hanging sheet-like display items that permits simple replacement of the display items and reuse of the apparatus.

These objects, and others, which become apparent as the specification progresses, are accomplished by the present apparatus for framing and hanging sheet-like display items which, briefly stated, comprises first and second generally identical elongate members, each member having a longitudinally extending channel forming first and second side walls for receiving an edge of the sheet-like display item. At least one generally cylindrical well is disposed within each elongate member wherein the well is transverse to the elongate member and parallel to the channel. Means are provided within the elongate members for captively retaining the edges of the sheet-like display item wherein the retaining means includes a generally cylindrical plug that mates snugly in the well and has a notch, forming a face with side edges and a seat, substantially corresponding to the channel. The plug is rotated within the well causing a side edge of the notch to press against the edge of the sheet-like display item thereby captively retaining the edge of the sheet-like display item within the channel. The apparatus may be formed from natural materials such as wood or stone as well as synthetic materials such as plastic. The apparatus for framing and hanging sheet-like display items may further comprise an elongate member cover that may provide a variety of decorative features.

DESCRIPTION OF THE PREFERRED EMBODIMENT

Figure 1:
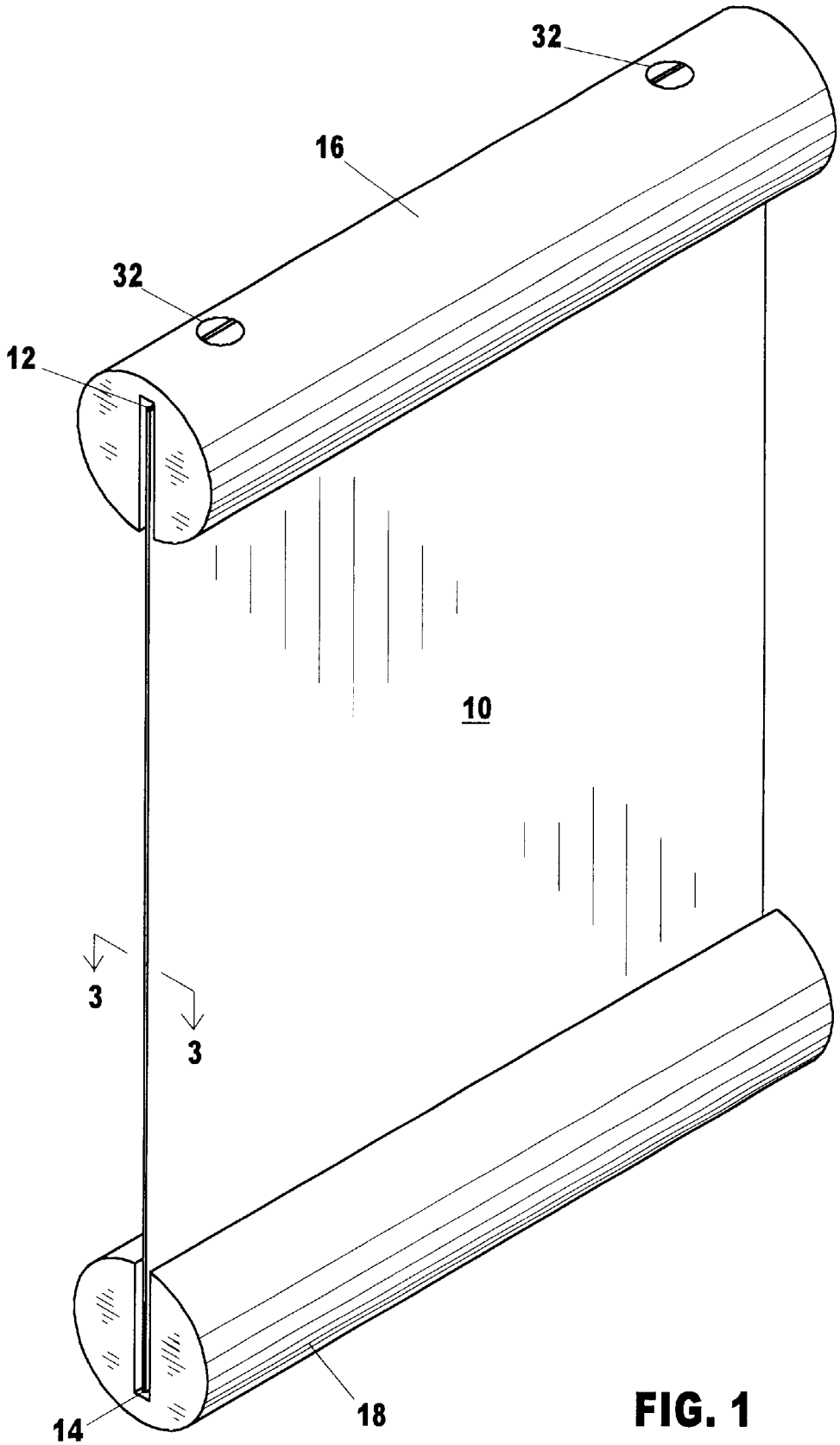
FIG. 1 is a perspective view of the apparatus for framing and hanging a sheet-like display item in accordance with the invention.
Figure 2:
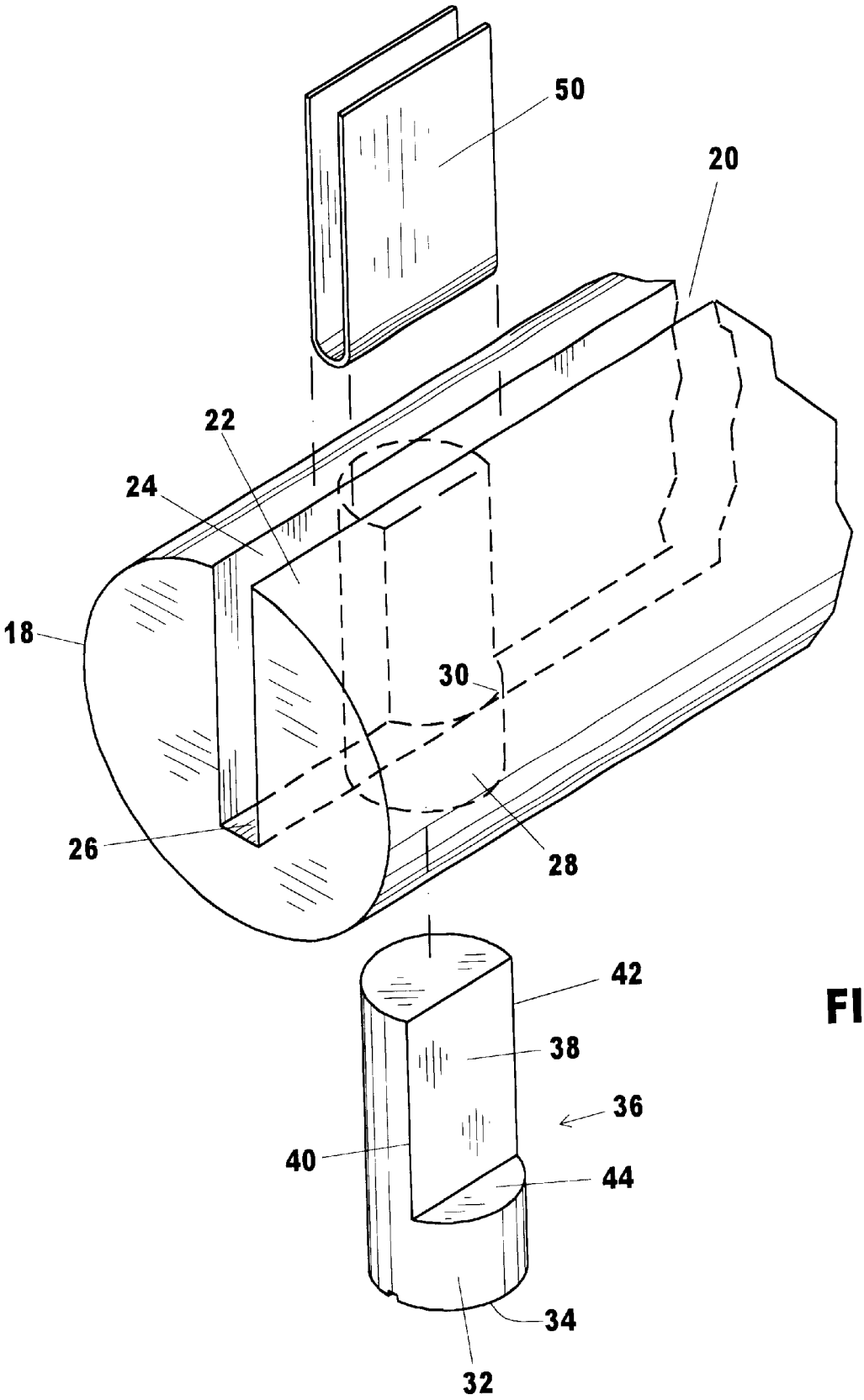
FIG. 2 is an enlarged, exploded perspective view, partially broken away, of the second elongate member, including retaining means, of the apparatus of FIG. 1.

Referring to the drawings, FIG. 1 shows an assembly including a sheet-like display item 10 suspended between first and second generally identical elongate members 16 and 18 attached to opposite edges 12 and 14 of the sheet-like display item 10. The first and second elongate members 16 and 18 are of the same configuration, but are reversed as to position. Accordingly, the following detailed description of the second elongate member 18 also applies to the first elongate member 16. Referring also to FIG. 2, the second elongate member 18 has a longitudinally extending channel 20 for receiving the edge 14 of the display item 10. The channel 20 forms first and second side walls 22 and 24, respectively, and channel bottom 26. Additionally, at least one generally cylindrical well 28 is disposed transversely within the second elongate member 18 such that the well 28 is parallel to the side walls 22 and 24 of the channel 20 and intersects at least the second side wall 24 of the channel 20. Preferably, the well 28 is positioned within the second elongate member 18 such that the perimeter 30 of the well 28 substantially contacts tangentially the first side wall 22 of the channel 20 while extending through the second side wall 24. Alternatively, the well 28 may be placed medially within the second elongate member 18 such that the well 28 extends through first and second side walls 22 and 24.

The material used to form the elongate members 16 and 18 is preferably a solid, natural material such as wood or marble. Alternatively, the elongate members 16 and 18 may be formed from a synthetic material such as plastic. The channel 18 and cylindrical well 28 may be introduced into the first and second elongate members 16 and 18 by conventional milling, cutting, and drilling techniques.

Figure 3:
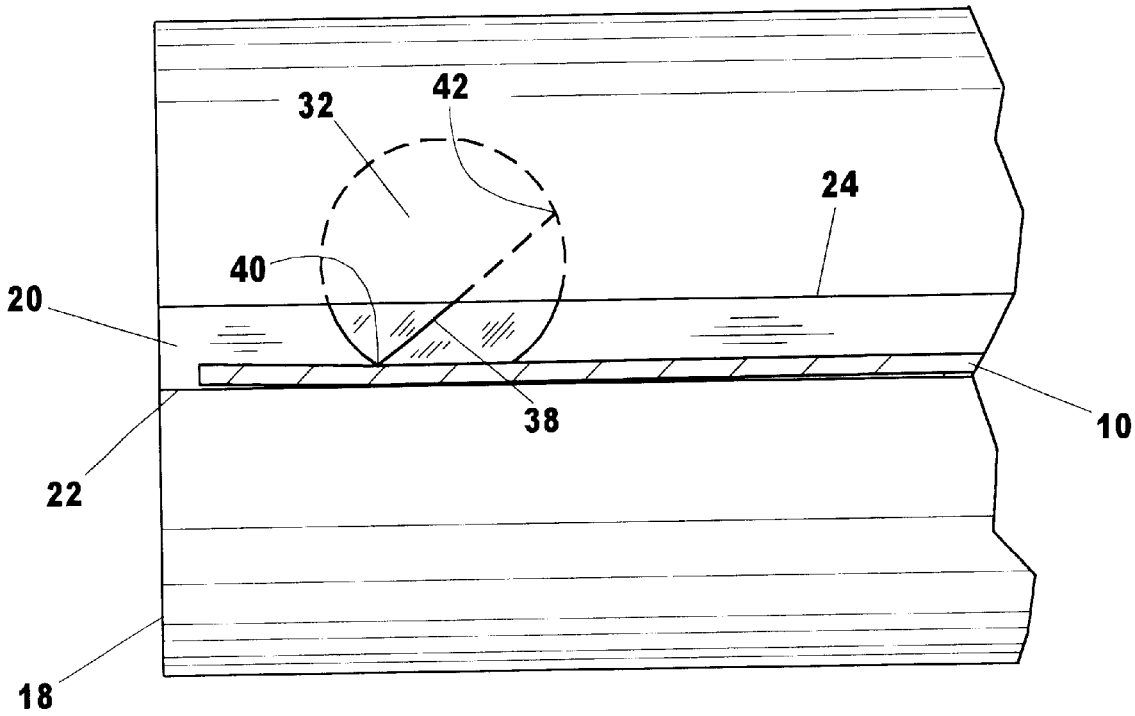
FIG. 3 is an enlarged, top plan view, partially in cross section and partially broken away, of the second elongate member including retaining means captively retaining a sheet-like display item viewed along line 3—3 of FIG. 1.
Figure 4:
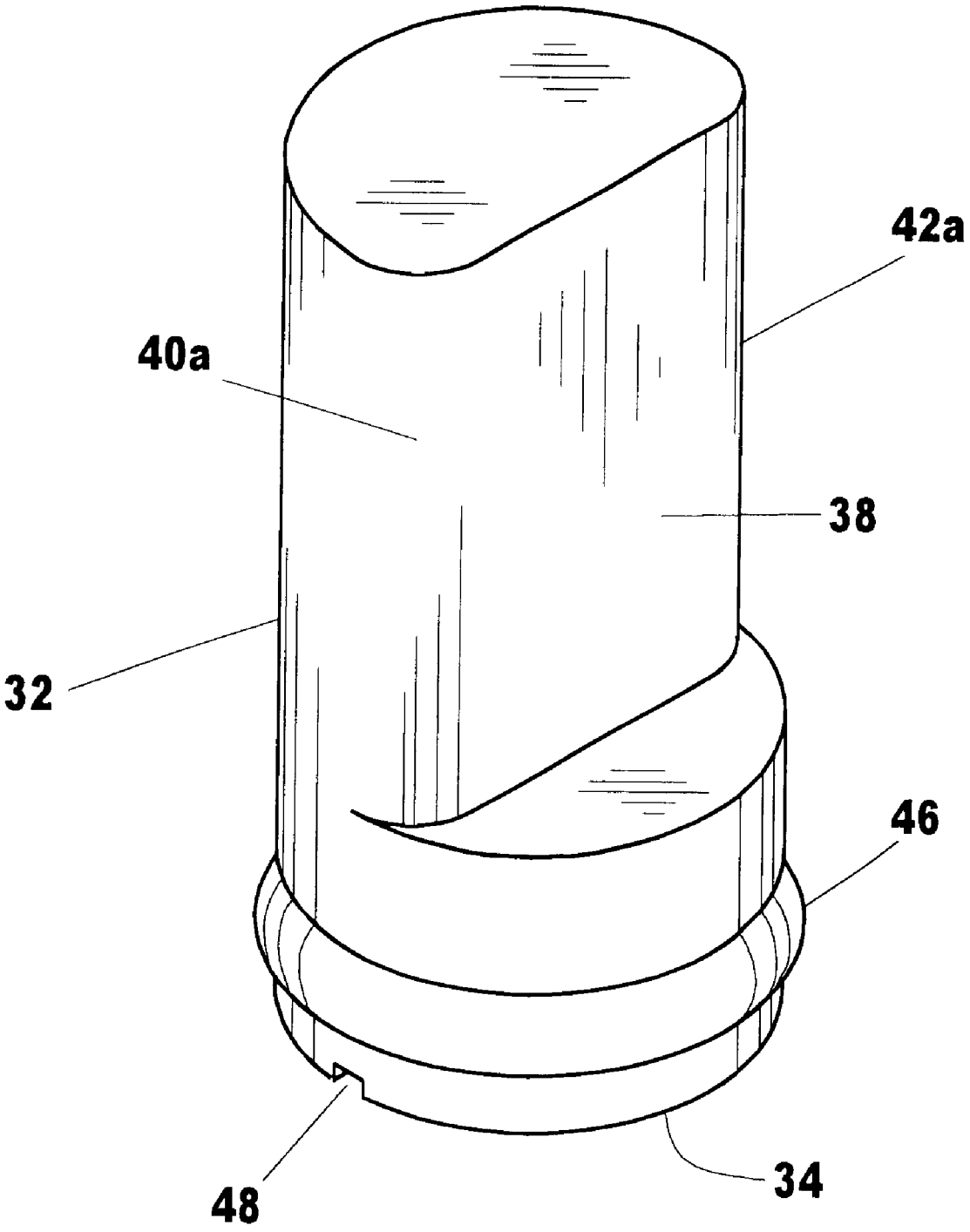
FIG. 4 is an enlarged, perspective view of alternative features of the plug of FIG. 2.

Referring to FIG. 1 and 2, means for captively retaining the edge 14 of the sheet-like display item 10 includes a generally cylindrical plug 32 having a base 34. The plug 32 is disposed within the well 28 such that the plug base 34 is accessible. The plug 32 is sized so that it mates snugly within the well 28. In addition, the plug 32 has a notch 36 that forms a face 38, with first and second side edges 40 and 42, and seat 44. The notch 36 generally corresponds to the channel 20 of the second elongate member 18, i.e., seat 44 generally corresponds with channel bottom 26. Referring to FIG. 3, retaining means captively retains the edge 14 of sheet-like display item 10 within the channel 20 when the plug 32 is rotated within the well 28 so that a side edge 40 or 42 of the notch face 38 compresses the sheet-like display item 10 against the first side wall 22 of the channel 20. As shown in FIG. 4, the side edges 40*a* and 42*a* of notch face 38 may be rounded to allow for different sheet-like display item thicknesses. The plug 32 may be provided with a ring 46 to secure the plug 32 within the well 28. Further, the plug base 34 may be provided with a recess 48 for receiving a screwdriver or some other tool such as a hex wrench. In addition, the proximity of the plug 32 to the first side wall 22 of the channel 20 may be varied depending on the thickness of the sheet-like display item 10.

To provide additional protection to the edge 14 of the sheet-like display item 10, the retaining means may further include a generally U-shaped sleeve 50, as shown in FIG. 2, that is provided within the channel 20 to cover the plug 32 so that neither side edge 40 nor 42 of the notch 36 directly contacts the sheet-like display item 10 when the plug 32 is rotated within the well 28. The sleeve 50 also assists in the captive retention of the sheet-like display item 10. The plug 32 and sleeve 50 may be formed from a synthetic material such as plastic.

The length of the first and second elongate members 16 and 18 and the number of retaining means may vary according to the size of the sheet-like display item 10. For relatively narrow display items, a single retaining means centrally positioned in each elongate member may be sufficient for captively retaining the edges of the display item. For wider display items, two retaining means positioned in the elongate members near the corners of the display item may be employed. Additional retaining means may be added and positioned appropriately in the elongate members as required by the width and/or weight of the display item.

Figure 5:
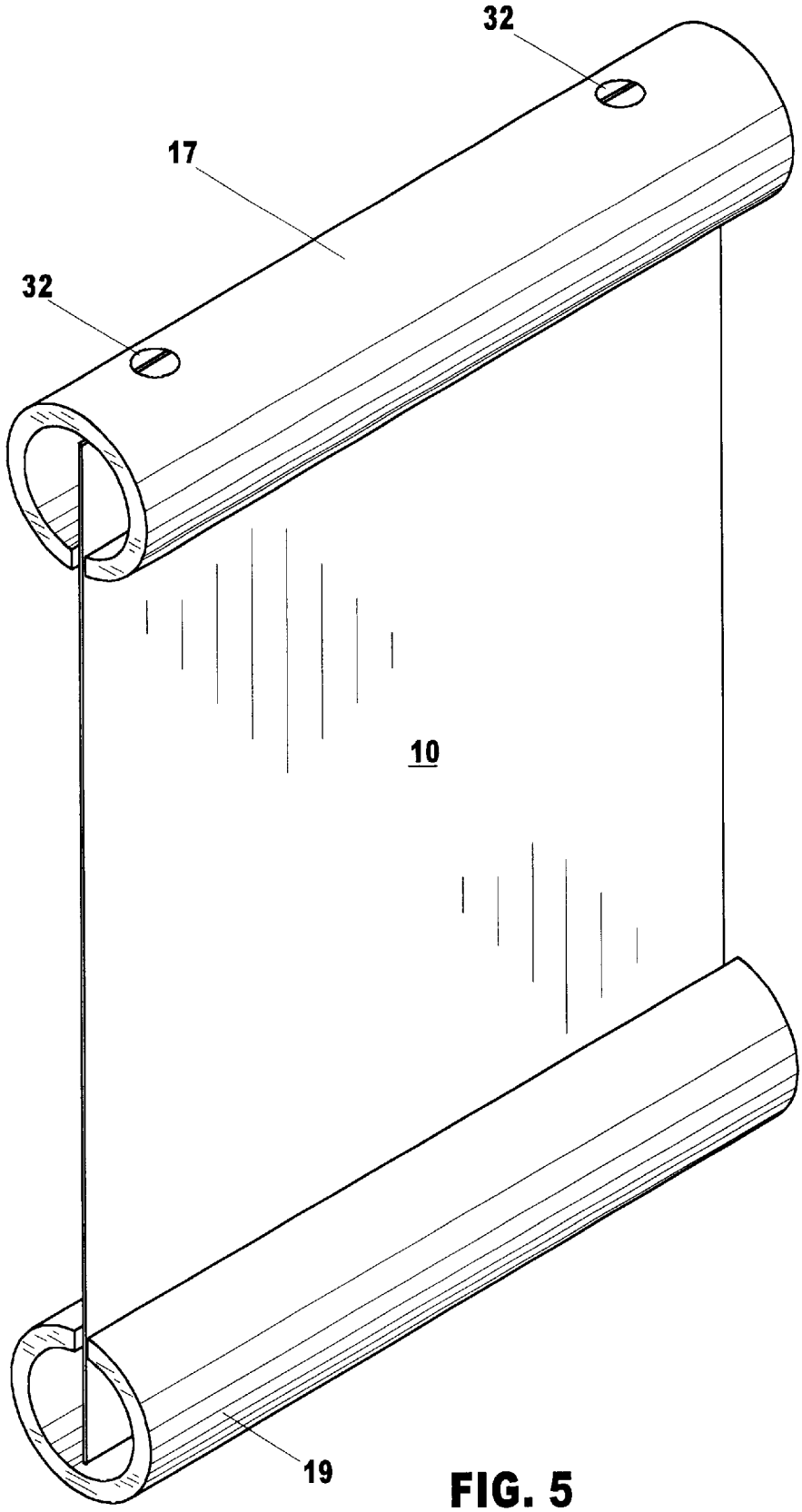
FIG. 5 is a perspective view of an alternative embodiment of the apparatus for framing and hanging a sheet-like display item in accordance with the invention.
Figure 6:
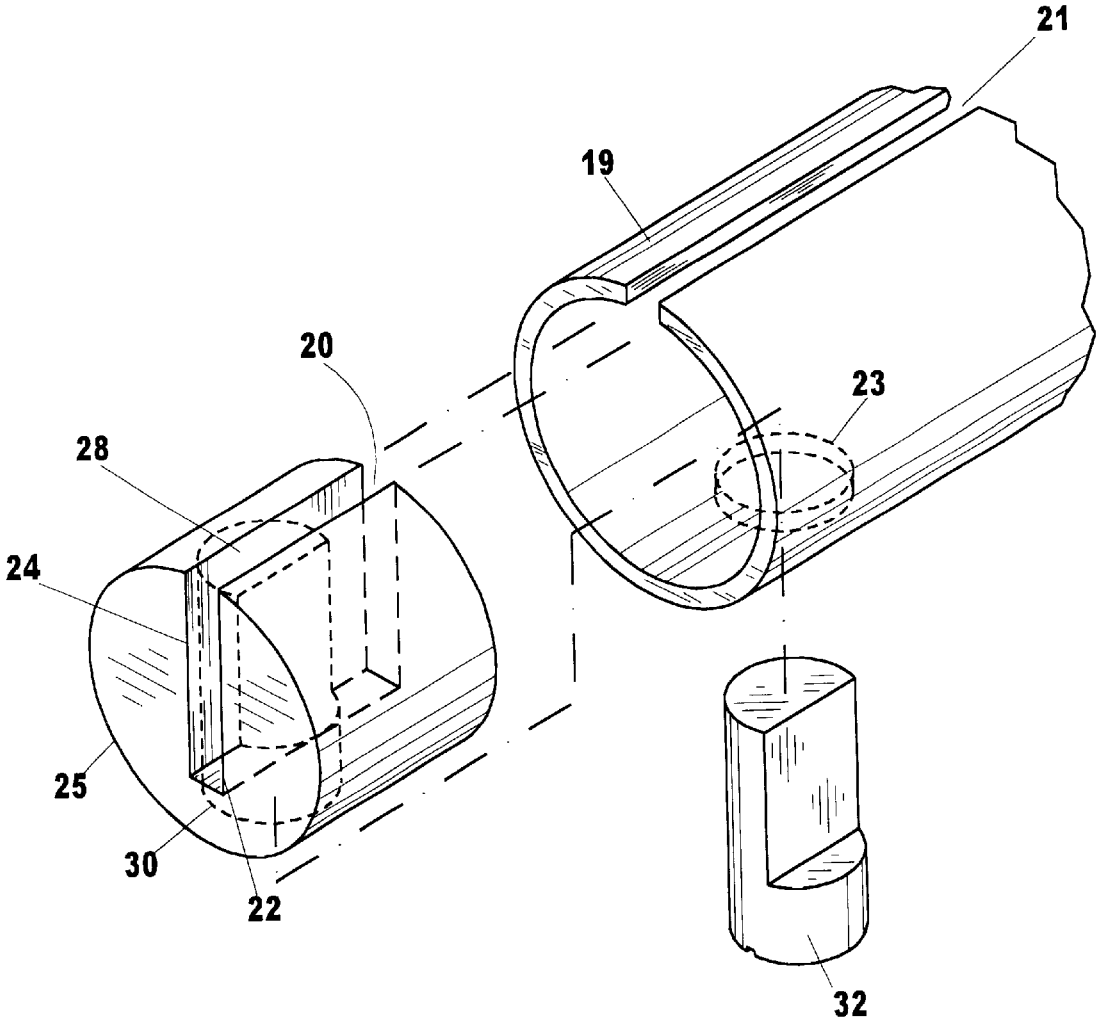
FIG. 6 is an enlarged, exploded perspective view, partially broken away, of the second elongate member, including retaining means, of the apparatus of FIG. 5.

Referring to FIG. 5, depicting an alternative embodiment of the present invention, the first and second elongate members 17 and 19 are hollow. The first and second hollow elongate members 17 and 19 are of the same configuration, but are reversed as to position. Accordingly, the following detailed description of the second hollow elongate member 19 also applies to the first hollow elongate member 17. As shown in FIG. 6, second hollow elongate member 19 has a longitudinally extending slot 21 and an aperture 23 positioned generally opposing the slot 21. To accommodate the retaining means described above, a housing 25 is disposed within the hollow elongate member 19 wherein the housing 25 mates with the interior of the second hollow elongate member 19. The housing 25 has a channel 20 forming first and second side walls 22 and 24, and a generally cylindrical well 28 positioned transversely within the housing 25, such that the well 28 is parallel to the side walls 22 and 24 of the channel 20 and intersects the second side wall 24 of the channel. More preferably, the well 28 is positioned within the housing 25 such that the perimeter 30 of the well 28 substantially contacts tangentially the first side wall 22 of the channel 20 while extending through the second side wall 24. Alternatively, the well 28 may be placed medially within the housing 25 such that the well 28 extends through first and second side walls 22 and 24. When the housing 25 is disposed within the second hollow elongate member 19, the opening of the channel 20 registers with the slot 21, and the well 28 registers with the aperture 23. As described in detail with respect to the first embodiment above, means for captively retaining the edge of the sheet-like display item 10 includes the plug 32 that is disposed within the well 28. Optionally, the U-shaped sleeve 50 may also be provided within the channel 20. The hollow elongate members, housing, plug and sleeve may be formed from metal, plastic, or the like.

Figure 7:
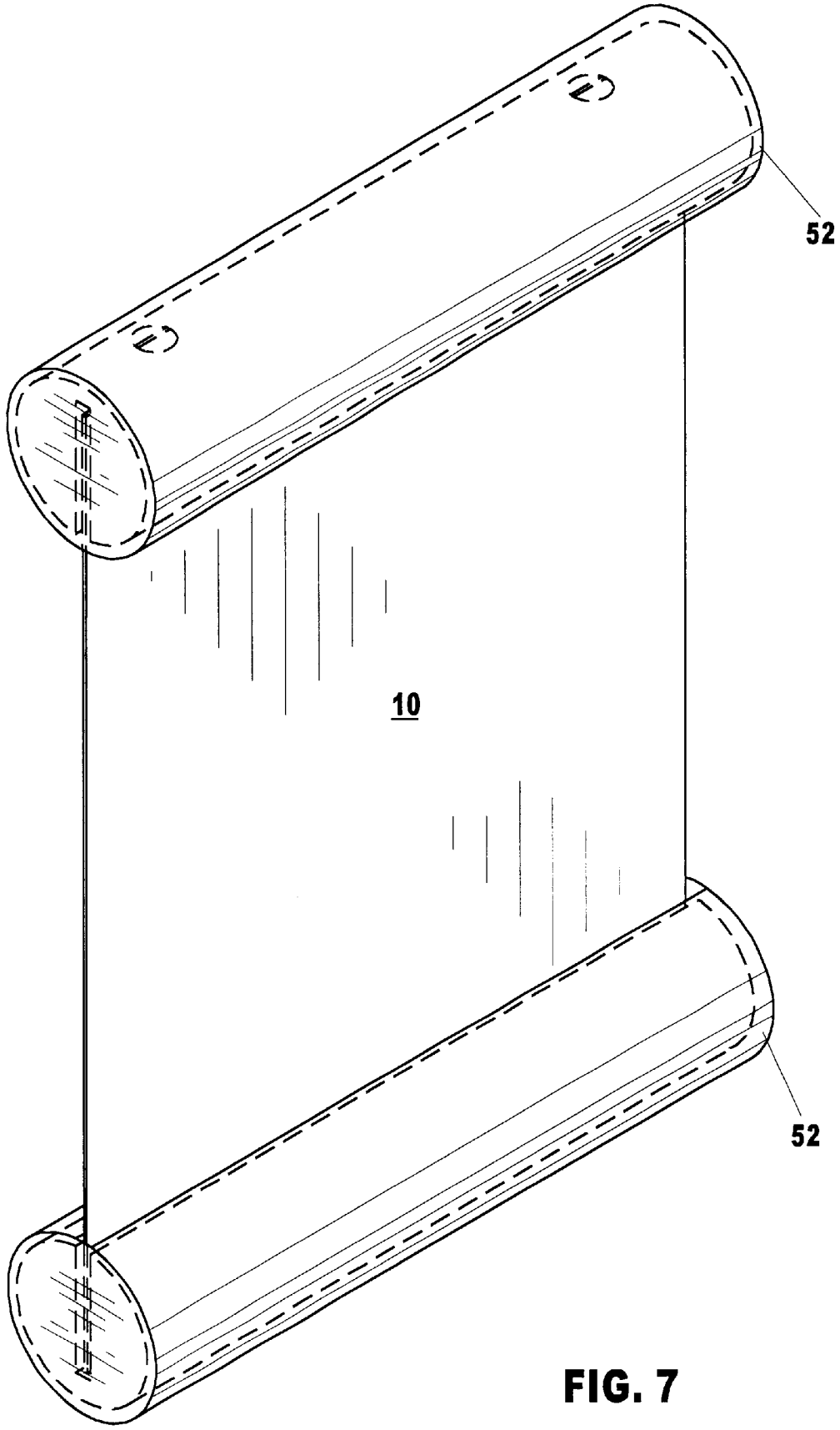
FIG. 7 is a perspective view of the apparatus for framing and hanging a sheet-like display item including the elongate member cover.

To provide different decorative features on the framing and hanging apparatus, one or both of the elongate members may be enclosed with an elongate member cover 52, as shown in FIG. 7. A variety of materials, e.g., cloth, leather, plastic, or faux fur, may be used to form the elongate member cover 52. Also, the outer profile of the elongate members may be varied to provide different decorative features. The framing and hanging apparatus of the present invention may be mounted or hung from ceilings or walls in a conventional manner. For example, the first elongate member 16 or first hollow elongate member 17 may be provided with a hole for hanging the assembly upon a nail or hook.

The above description of the present invention is susceptible to various modifications, changes and adaptations, and the same are intended to be comprehended within the meaning and range of equivalents of the following claims.

I claim:

1. An apparatus for framing and hanging a sheet-like display item, the apparatus comprising:

first and second generally identical elongate members, each member having a longitudinally extending channel forming first and second side walls for receiving an edge of the sheet-like display item and a generally cylindrical well disposed transversely within the member and parallel to the channel; and means for captively retaining an edge of the sheet-like display item disposed in the cylindrical well.

2. The apparatus of claim 1 wherein the retaining means comprises a generally cylindrical plug that mates snugly in the well, the plug having a notch, forming a face with side edges and a seat, substantially corresponding to the channel, and a base.

3. The apparatus of claim 2, wherein the perimeter of the well substantially contacts tangentially the first side wall and extends through the second side wall.

4. The apparatus of claim 3, wherein the retaining means further comprises a U-shaped sleeve seated in the channel for covering the plug.

5. The apparatus of claim 3, wherein a side edge of the notch face is rounded.

6. The apparatus of claim 3, wherein the plug has a ring to secure the plug in the well and the plug base has a recess for receiving a tool.

7. The apparatus of claim 3 further comprising an elongate member cover.

8. An apparatus for framing and hanging a sheet-like display item, the apparatus comprising:

first and second generally identical elongate members, each member having a longitudinally extending channel forming first and second side walls for receiving an edge of the sheet-like display item and a generally cylindrical well disposed transversely within the member and parallel to the channel; and a generally cylindrical plug that mates snugly in the well, the plug having a notch, forming a face with side edges and a seat, substantially corresponding to the channel, and a base.

9. The apparatus of claim 8, wherein the perimeter of the well substantially contacts tangentially the first side wall while extending through the second side wall.

10. The apparatus of claim 9 further comprising a U-shaped sleeve seated in the channel for covering the plug.

11. The apparatus of claim 9, wherein a side edge of the notch face is rounded.

12. The apparatus of claim 9, wherein the plug has a ring to secure the plug in the well and the plug base has a recess for receiving a tool.

13. The apparatus of claim 9 further comprising an elongate member cover.

14. An apparatus for framing and hanging a sheet-like display item, the apparatus comprising:

first and second generally identical hollow elongate members, each member having a longitudinally extending slot for receiving an edge of the sheet-like display item and an aperture positioned generally opposite the slot;

a housing disposed within the first and second hollow elongate members, the housing having a channel forming first and second side walls, the opening of the channel substantially registering with the slot, and a generally cylindrical well disposed transversely within the housing parallel to the channel, the opening of the well substantially registering with the aperture; and a generally cylindrical plug that mates snugly in the well, the plug having a notch, forming a face with side edges and a seat, substantially corresponding to the channel, and a base.

15. The apparatus of claim 14, wherein the perimeter of the well substantially contacts tangentially the first side wall while extending through the second side wall.

16. The apparatus of claim 15 further comprising a U-shaped sleeve seated in the channel for covering the plug.

17. The apparatus of claim 15, wherein a side edge of the notch face is rounded.

18. The apparatus of claim 15, wherein the plug has a ring to secure the plug in the well and the plug base has a recess for receiving a tool.

19. The apparatus of claim 15 further comprising a hollow elongate member cover.

* * * * *